United States Patent [19]

Douthwaite

[11] 4,003,178

[45] Jan. 18, 1977

[54] OPEN MESH METAL PANELS

[76] Inventor: Robert Charles Douthwaite, 2, Elloughton Grove, Castle Park, Cottingham, North Humberside, England

[22] Filed: May 13, 1975

[21] Appl. No.: 577,125

[30] Foreign Application Priority Data

May 13, 1974 United Kingdom ..... 21065/74

[52] U.S. Cl. ..... 52/664; 52/648

[51] Int. Cl.[2] ..... E04C 2/42

[58] Field of Search ..... 52/664, 647, 600, 630, 52/342, 343, 672, 671, 601, 602, 650, 660, 626, 661, 662

[56] References Cited

UNITED STATES PATENTS

| | | | |
|---|---|---|---|
| 1,309,242 | 7/1919 | Clark | 52/650 |
| 2,412,618 | 12/1946 | Kautz | 52/664 |
| 2,842,232 | 7/1958 | Walsh | 52/660 X |
| 3,748,720 | 7/1973 | Versteeg | 52/664 X |

*Primary Examiner*—Price C. Faw, Jr.
*Assistant Examiner*—Carl D. Friedman
*Attorney, Agent, or Firm*—William Anthony Drucker

[57] ABSTRACT

A length or panel of welded wire rod mesh with at least one rigid metal strengthening member said length or panel having corrugations or deformed regions at speed intervals to off-set rods extending in the same direction in said corrugated or deformed regions from parallel rods between said corrugated or deformed regions, the said rigid metal strengthening member being passed through at least two corrugated or deformed regions so that said off-set rods lie on one side of the member and the parallel rods between the corrugated or deformed regions lie on the side of said member.

6 Claims, 5 Drawing Figures

OPEN MESH METAL PANELS

This invention relates to panels or sheets of welded wire rod mesh.

Welded wire rod mesh has advantage as regards strength but in length and as panels is flexible and liable to distortion. To overcome such lack or rigidity it is known to fold over the opposite edges and to weld such edges to the web, and it has been proposed to use such material as panels forming the walls of cattle, pig and like pens with securing to vertical members set in the ground or foundation.

Now the object of the present invention is to provide welded wire rod mesh panels which are rigid and may form the wall of an enclosure or barrier by inter-connection of one with another, and with or without attachment to uprights, and have other uses such as reinforcement of concrete floors, ceilings and the like.

According to the present invention a length or panel of welded wire rod mesh is corrugated or deformed at spaced intervals such that rods extending in the same directions are off-set from the remaining rods parallel thereto with deformation of the adjacent portions of the rods at right angles thereto, and a rigid metal member is inserted through between the off-set rods and those parallel thereto at least along one edge.

The rigid metal member may be a mild steel rod or bar, and is preferably an angle section bar, and such member may be welded to some or all of the wires of mesh between which it is located and with which it abuts.

In an alternative, the rigid member may comprise a bar made of perforated strip or heavy gauge wire or mesh or expanded metal as a flat strip or angle or roll of dimension enabling its positioning in the apertures of the off-set rods by threading through, and with or without turning about its axis, prior to fixing as by welding.

Preferably a rigid metal member is provided along the two opposite edges and one or more intermediate like members may also be provided, and it is further preferred that the ends of the rigid metal members project beyond the ends of the sheet or panel for the convenient attachment of panels either in alignment or at an angle one to another and/or to uprights.

The ends of the parallel rods adjacent where the rigid metal member is provided may project only slightly beyond the edge rod at right angles thereto or may substantially project as a deterent to climbing over when the panels are used as the wall of an enclosure or barrier.

An embodiment of the invention and a use thereof are, by way of example, hereinafter more fully described with reference to the accompanying drawings, in which.

Figure 1:
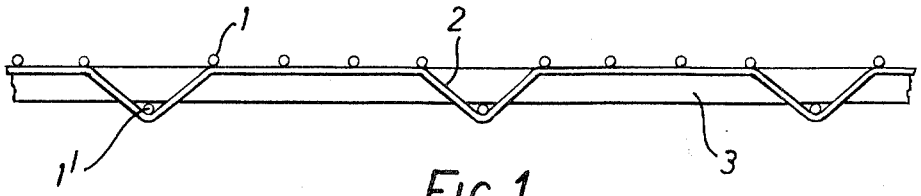
FIG. 1 is a plan or edge view of a panel.
Figure 2:
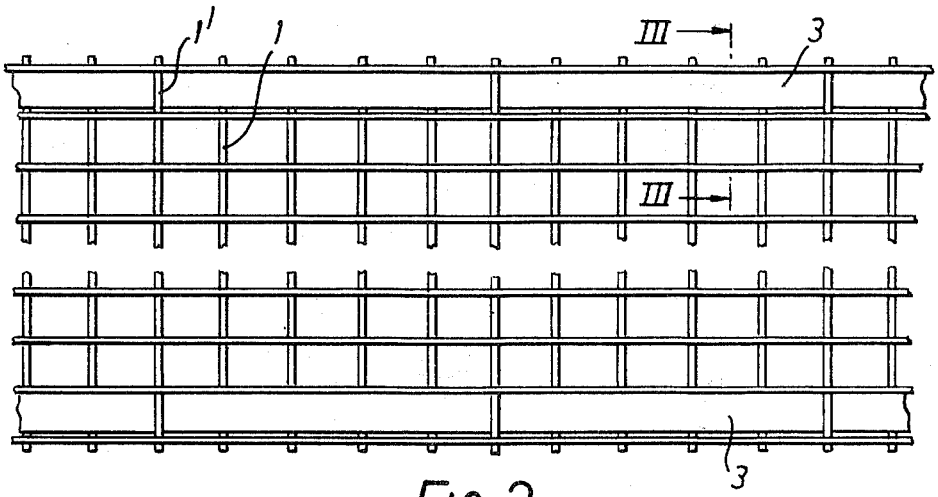
FIG. 2 is a front or face view of a panel with rigid metal members along both opposite edges.
Figure 3:
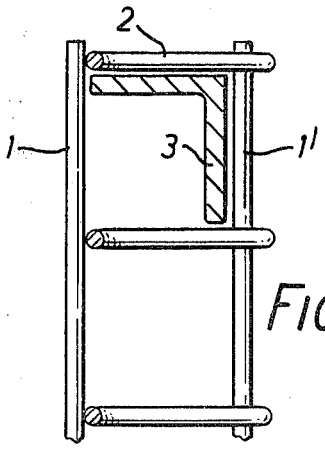
FIG. 3 is a detail view on an enlarged scale on the line III—III of FIG. 1.

A length of commercially available welded wire rod mesh, comprising rods 1 in spaced parallel relationship welded at junction points to rods 2 also in parallel relationship and at right angles to the rods 1, is corrugated or deformed at spaced intervals so that some of the rods $1^1$ are off-set from the remaining rods 1 as may be seen in FIG. 1. Through the spaces between the displaced rods $1^1$ and the remaining rods 1 parallel thereto and between adjacent rods 2, a rigid metal member 3 is inserted (see FIG. 3) and is welded to at least some of the rods 1 or $1^1$ with which it abuts. The member 3 is preferably an angle section bar as shown in FIG. 3 and preferably one such member is provided at each of the opposite edges of the panels as shown in FIG. 2.

Figure 4:
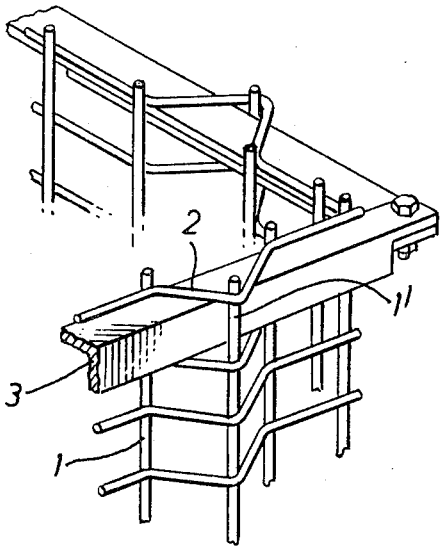
FIG. 4 is another detail view showing the ends of two panels at right angles connected to one another.
Figure 5:
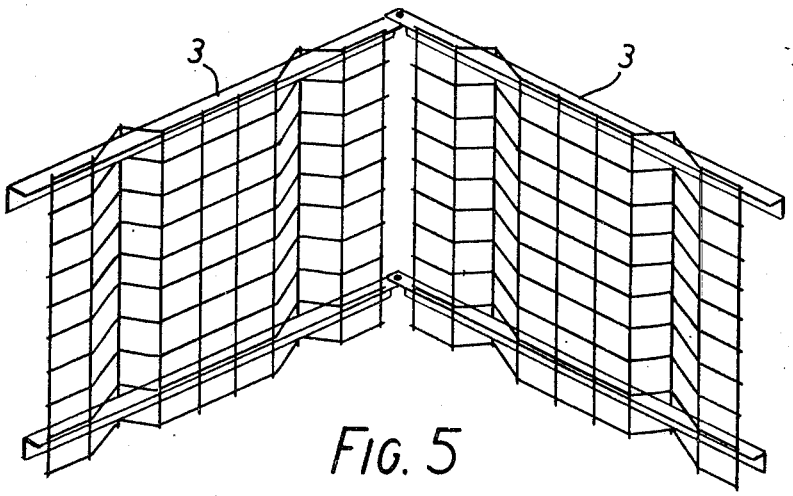
FIG. 5 shows part of two panels joined as in FIG. 4 and forming part of a pen or like enclosure.

A panel so constructed is suitable for forming a crowd barrier by connection to uprights and as wall units of pens for cattle, pigs and other animals by connection to one another and/or to uprights. Thus it is further preferred as shown in FIG. 4 that the (or each) member 3 projects beyond the ends of a panel for convenient bolting together with the panels in alignment or at an angle to one another as shown in FIG. 5.

A panel may also form reinforcement for a concrete structure when the off-set rods $1^1$ space the rest of the rods from shuttering or base.

When a panel is to be galvanised or coated with plastics material, the galvanising or coating is carried out after formation of the panel with its one or more rigid metal members and weld securing of such member(s).

I claim:

1. A length or panel of welded wire rod mesh defined by longitudinal rods, equally spaced apart and transverse rods, equally spaced apart and, which panel is corrugated or deformed at spaced intervals such that rods extending in the same direction are off-set from the remaining rods parallel thereto with deformation of the adjacent portions of the rods at right angles thereto, and a rigid metal member is inserted through between the off-set rods and those parallel thereto at least adjacent one edge.

2. A length or panel of welded wire rod mesh as claimed in claim 1 in which a rigid metal member is provided along the two opposite edges.

3. A length or panel of welded wire rod mesh as claimed in claim 1 in which a rigid metal member is also provided intermediate the two opposite edges transverse to the direction of the corrugations or deformations in the panel.

4. A length or panel or welded wire rod mesh as claimed in claim 1, in which the rigid metal member is an angle section bar.

5. A length or panel of welded wire rod mesh as claimed in claim 1, in which the ends of each rigid metal member project beyond the ends of the panel.

6. A length or panel of welded wire rod mesh as claimed in claim 1 in which each rigid metal member is welded to some or all of wire rods with which it abuts.

* * * * *